US005749716A

United States Patent [19]

Abelen et al.

[11] Patent Number: 5,749,716

[45] Date of Patent: May 12, 1998

[54] INTEGRATED OIL PUMP ROTOR AND COUPLING PIECE FOR AN OIL-SEALED VACUUM PUMP

[75] Inventors: Thomas Abelen, Cologne; Lutz Arndt, Troisdorf; Peter Muller, Cologne, all of Germany

[73] Assignee: Leybold Aktiengesellschaft, Cologne, Germany

[21] Appl. No.: 586,928

[22] PCT Filed: May 26, 1994

[86] PCT No.: PCT/EP94/01680

§ 371 Date: Jan. 29, 1996

§ 102(e) Date: Jan. 29, 1996

[87] PCT Pub. No.: WO95/04222

PCT Pub. Date: Feb. 9, 1995

[30] Foreign Application Priority Data

Jul. 28, 1993 [DE] Germany ..... 43 25 285.0

[51] Int. Cl.[6] ..... F04B 17/00

[52] U.S. Cl. ..... 417/410.3; 418/88; 403/354

[58] Field of Search ..... 417/410.3; 418/248, 418/88; 403/354, 375

[56] References Cited

U.S. PATENT DOCUMENTS 4,276,005 6/1981 Bassan ..... 418/88
5,236,313 8/1993 Kim ..... 417/281

FOREIGN PATENT DOCUMENTS 2354039 5/1975 Germany .
2401171 7/1975 Germany ..... 417/410.3

*Primary Examiner*—Timothy Thorpe
*Assistant Examiner*—Cheryl J. Tyler
*Attorney, Agent, or Firm*—Harris Beach & Wilcox, LLP

[57] ABSTRACT

The invention pertains to an oil-sealed vacuum pump (1) with a pump chamber (8, 9), with a rotor 3 rotatively mounted therein, with a bearing piece (13) delimiting the pump chamber on the drive side and with a passage (35) in the bearing piece (13) which contains a coupling piece (37) used to interlock the rotor (3) with the shaft (36) of the drive motor (4) and a sealing ring (55) to seal off the coupling piece from the passage (35) in the bearing piece (13). To simplify manufacture of the pump, the invention proposes that the interlocking connections between rotor (3) and coupling piece (37) as well as coupling piece (37) and shaft (36) are effected from the faces, and that the coupling piece (37) is a support for a rotor (46) for an oil pump (45, 46), the pump chamber (45) of which is formed in the end plate (13).

14 Claims, 2 Drawing Sheets

INTEGRATED OIL PUMP ROTOR AND COUPLING PIECE FOR AN OIL-SEALED VACUUM PUMP

BACKGROUND OF THE INVENTION

The invention pertains to an oil-sealed vacuum pump with a pump chamber, with a rotor rotatively mounted therein, with a bearing piece delimiting the pump chamber on the drive side and with a passage in the bearing piece which contains a coupling piece used to interlock the rotor with the shaft of a drive motor and a sealing ring to seal off the coupling piece from the passage in the end plate.

A vacuum pump of this kind is known from DE-A-23 54 039. In the case of this known pump, the inserted coupling piece has a pot-like shape. The shaft of the drive motor engages into the inside space of the coupling piece and is linked to it via radial cams by way of a positive fit. This solution necessitates that the coupling piece be manufactured with very close tolerances as well as precise central mounting of the drive shaft or the drive motor, so that the sealing effect and the service life of the shaft sealing rings running on the coupling piece is not impaired by a non-centric rotation of the coupling piece. Moreover, the known vacuum pump is not equipped with an oil pump. The effect of the oil flow from the oil sump to the locations which must be supplied with oil (pump chambers, bearing bore etc.) relies on the presence of a low pressure in the area of these locations during normal operation.

However, this suction effect is not present when the vacuum pump is operated at an intake pressure of about 1000 mbar (atmospheric pressure). This is the case, for example, when the chamber which is to be evacuated has developed a fault. If such faults are not determined immediately, there is the danger that substantial damage will occur in the vacuum pump owing to the lack of lubricant.

SUMMARY OF THE INVENTION

It is the task of the present invention to create an oil-sealed vacuum pump of the aforementioned kind, the coupling piece of which may be manufactured and mounted in an easier manner without impairing leaktightness within the end plate. Moreover, the pump shall be equipped with an oil pump, production of which is more cost-effective.

This task is solved by the characteristic features of the patent claims.

The coupling piece designed according to the present invention has besides the known functions (coupling, running surface for a shaft sealing ring), the additional function of being the carrier and drive for a rotor of an oil pump. The total number of parts which have to be manufactured is thus reduced. Moreover, the coupling piece itself can be manufactured in a simpler manner, since it no longer requires a central pocket hole. Precise central running of the coupling piece is hardly impaired any more owing to each of the positive fit connections on the face sides for the rotor or for the shaft of the drive motor.

BRIEF DESCRIPTION OF THE DRAWINGS

Further advantages and details of the present invention shall be explained by referring to drawing FIGS. 1 to 5.

Drawing

Drawing

Drawing

Drawing

Drawing

Drawing

Drawing

DESCRIPTION OF THE INVENTION

Figure 1:
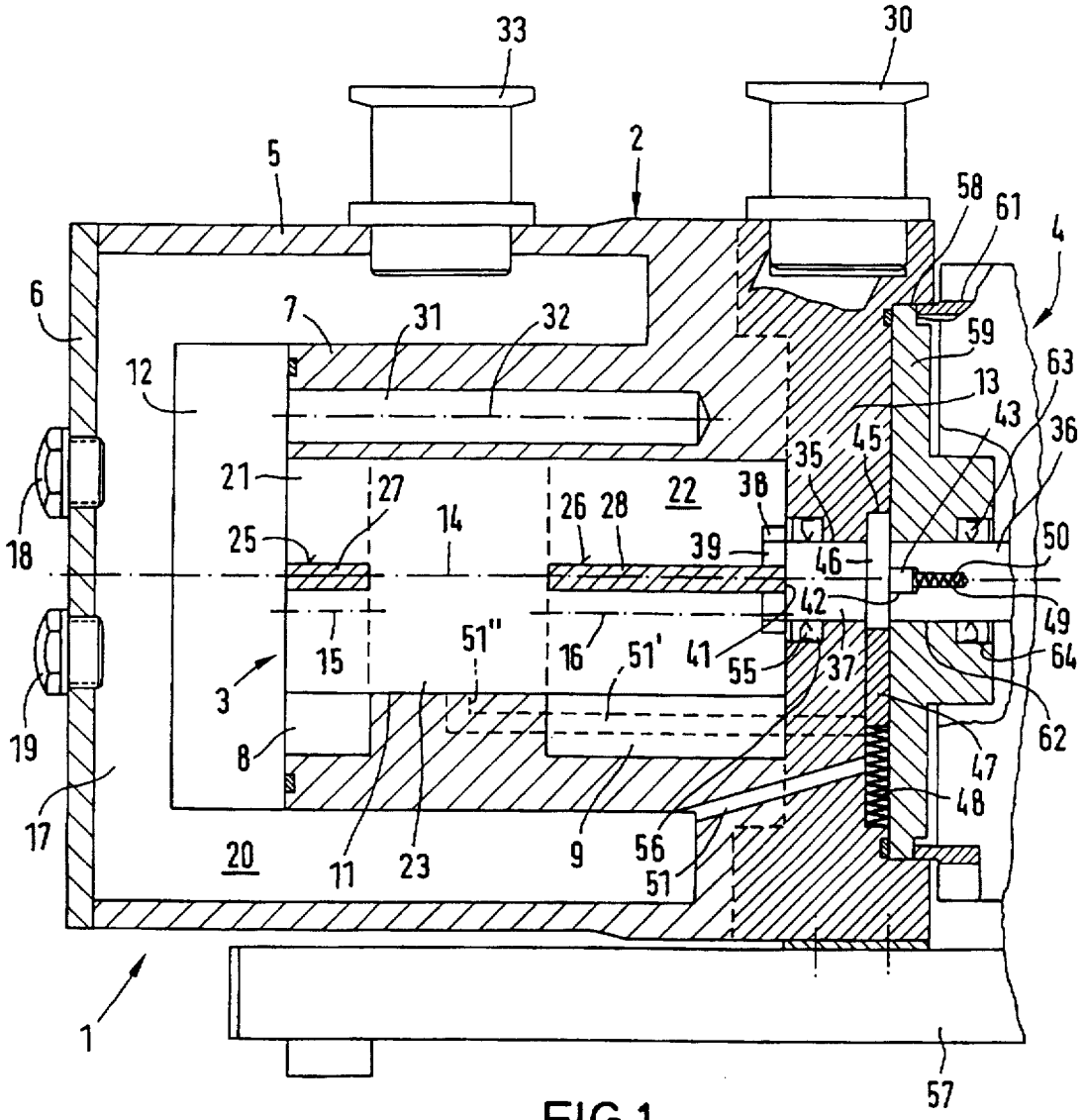
FIG. 1 shows a longitudinal section through a design example for a rotary vane pump according to the present invention.

The presented pump 1 comprises chiefly the subassemblies housing 2, rotor 3 and drive motor 4.

Housing 2 substantially has the shape of a pot with an outer wall 5, with the lid 6, with an inside section 7 containing pump chambers 8, 9 as well as bearing bore 11 with end piece 12 and bearing piece 13, which limit on their face sides the pump chambers 8, 9. The axis of the bearing bore 11 is designated as 14. Arranged eccentrically to this, are the axes 15 and 16 of the pump chambers 8, 9. Oil space 17, which, during operation of the pump is partly filled with oil, is situated between outer wall 5 and the inside section 7. Two oil level glasses 18, 19 (maximum, minimum oil level) are provided in lid 6 for checking the oil level. Oil-fill and oil-drain ports are not shown.

Figure 2:
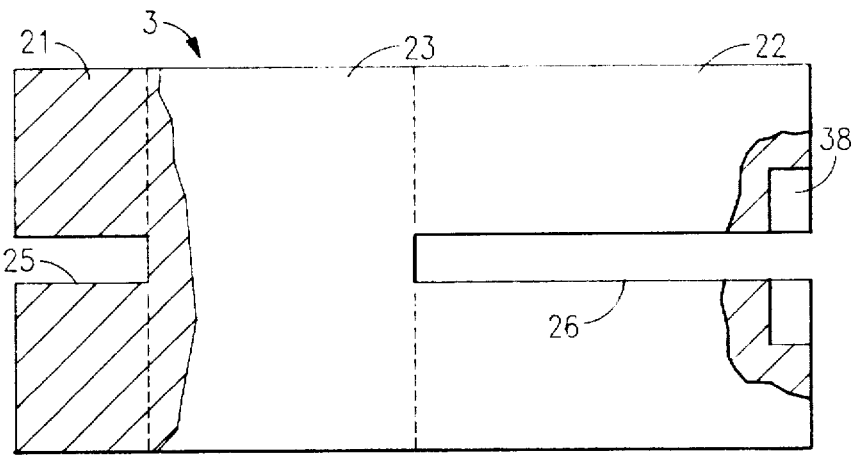
FIG. 2 shows a rotor according to the present invention.
Figure 3:
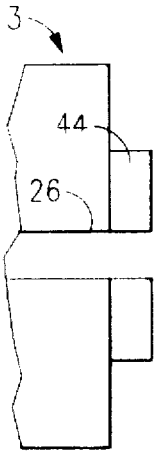
FIG. 3 shows one face side of the rotor with projections.

Rotor 3 which is shown once more in drawing FIGS. 2 and 3, is situated within inside section 7. The rotor is made of one piece and has two anchor segments 21, 22 arranged on the face side and a bearing segment 23 situated between the anchor segments 21, 22. Bearing segment 23 and anchor segments 21, 22 are of identical diameter. Anchor segments 21, 22 are equipped with slots 25, 26 for vanes 27, 28. These are milled from each of the corresponding face sides of the rotor so that precise slot dimensions can be easily attained. Bearing segment 23 is situated between anchor segments 21, 22. Bearing segment 23 and bearing bore 11 form the sole bearing of the rotor. This bearing must have a sufficient axial length so as to avoid a gyratory motion of the rotor. The length of the bearing is preferably selected so that in the case of a maximally angled orientation of rotor 3 owing to bearing play in bearing bore 11, the rotor 3 still remains afloat, i.e. it not touches down simultaneously at both its face sides.

The anchor segment 22 and the corresponding pump chamber 9 are made longer than anchor segment 21 with pump chamber 8. Anchor segment 22 and pump chamber 9 form the high vacuum stage. During operation, the inlet of the high vacuum stage 9, 22 is linked to intake port 30. The discharge of the high vacuum stage 9, 22 and the inlet of the fore-vacuum stage 8, 21 are linked via bore 31 with its axis 32, which extends in parallel to axes 15, 16 of the pump chambers 8, 9. The discharge of the fore-vacuum stage 8, 21 leads to the oil space 17 which comprises oil sump 20. There the oil containing gases quieten down and leave the pump 1 through exhaust port 33. For reasons of clarity, the inlet and discharge openings of the two pump stages are not shown in drawing FIG. 1 The housing 2 of the pump is preferably also made of as few parts as possible. At least the two pump chambers 8, 9 and the wall sections 5, 7 embracing the oil space 17 should be made of one piece.

The bearing piece 13 is equipped with a bore 35 for a rotor drive, said bore extending coaxially with respect to axis 14 of bearing bore 11. This rotor drive may be coupled directly the shaft 36 of the drive motor 4. In the design example presented in drawing FIG. 1, a coupling piece 37 is provided between the unoccupied face side of drive shaft 4 and the rotor 3. The coupling of the rotor 3 to the coupling piece 37, as well as coupling of the coupling piece 37 to the drive shaft 36 is performed by way of a positive fit via projections and corresponding recesses. In the design example presented, the rotor 3 is equipped on its face side facing the coupling piece 37, with an oblong recess 38 which extends perpendicular to vane slot 26 (refer also to drawing FIG. 2). Coupling piece 37 engages via an oblong projection 39 into recess 38. The projection 39 of the coupling piece 37 is in turn equipped with a recess 41, which embraces vane 28. A corresponding link exists between the drive shaft 36 with its oblong recess 42 and the coupling piece 37 with the corresponding projection 43.

The recesses 38, 42, and the projections 39, 43 may also be interchanged. Shown in drawing FIG. 3 is a further solution, in which the face side of rotor 3 on the side of the drive is equipped with a projection 44 which is reduced in diameter. Thus a slot is created next to the space occupied by the vane into which an oblong projection on coupling piece 37 or on shaft 36 may engage.

In many, particularly larger two-stage vacuum pumps, the high vacuum stage 9, 22 shall have a higher pumping speed than the fore-vacuum stage. In order to achieve this for identical diameters of the anchor segments, the axial length of the high vacuum stage must[1)] be greater than the axial length of the fore-vacuum stage, at least twice as long, for example. By arranging the high vacuum stage on the side of the drive, the advantage results that only the short fore-vacuum stage is cantilevered, whereas the relatively long high vacuum stage is supported in the coupling piece 37—or if this is not present—in shaft 36.

[1)] Translator's note: The German text reads . . . ist muß . . . (i.e. . . . is must . . . ). Since this does not make sense only „must" has been assumed for the translation.

Finally the pump according to drawing FIG. 1 is also equipped with an oil pump. This consists of pump chamber 45 sunk into bearing piece 13 from the side of the motor with eccentric 46 rotating within the pump chamber. A stopper 47 which is tensioned by spiral spring 48 rests against the eccentric.

The inlet of the oil pump 45, 46 is linked to the oil sump 20 via a bore 51. All parts of the pump 1 which require oil are linked to the discharge of the oil pump 45, 46. Presented as an example is a bore 51' which leads via a crossing bore 51" in the bearing segment 11 into the inside section 7 of the pump 1 and which supplies the bearing situated there with lubricating oil.

In the design example according to drawing FIG. 1, the eccentric 46 of the oil pump is part of the coupling piece 37. It is either fixed or attached by means of a positive fit —arranged axially movable on projection 42—to the coupling piece 37. In all, the solution which has been described, offers the possibility of being able to dispense with a separate bearing for the motor shaft 36 on the pump side. The bearing piece 13 and—if present—the coupling piece 37 may take over this function. Moreover, there exists the possibility to generate in the area of the shown face side of shaft 36, setting forces for the bearing present in the area of the not shown face side of shaft 36. For this the shown face side is provided with a central pocket hole 49 in which pressure spring 50 is situated. Pressure spring 50 is supported by the projection 43 of the coupling piece 37 as well as by the pocket hole 49 and generates forces which oppose each other on shaft 36[2)] (setting forces for the not shown bearing of shaft 36) and the coupling piece 37. Particularly, in the case of an axially movable eccentric 46, these forces also act upon rotor 3, the fore-vacuum face side of which is thus forced against the end piece 12. This force reduces the slot existing between the face side of the rotor and the end piece 12 which occurs owing to play, so that a substantial improvement of the compression capacity and thus an improved ultimate pressure can be attained. This tightness advantage in the area of the fore-vacuum stage results independently of the existing tolerances and can thus be attained without specially increasing the complexity of the manufacturing process.

[2)] Translator's note: The German sentence here assigns 37 to the shaft. 36 should be assigned instead, this being in line with the remaining text and the numbers in the drawing figures. The latter has been assumed for the translation.

Coupling piece 37 also forms the running surface for a sealing ring 55 which is situated in a ring-shaped recess 56 in the bearing piece 13, specifically on the side of bearing piece 13 facing the pump chamber 9. If rotor 3 is directly coupled to the drive shaft 36, then bearing piece 13 may be equipped with a further recess—on the side of the motor—for a sealing ring. Finally, bearing piece 13 has the function of supporting pump 1 via the base 57 screwed to bearing piece 13.

In the design example with the oil pump 45, 46 which is presented, the bearing piece 13 is equipped on its side facing motor 4, with a circular recess 58 in which a piece 59 is located. This piece is maintained in its position by the housing 61 of drive motor 4. It is equipped with a central bore 62 through which shaft 36 of the drive motor 4 passes. The shaft 36 forms the running surface for a second shaft sealing ring 63 which is situated in a recess 64 on the side of the motor in piece 59. Moreover, it is the task of piece 59 to limit the pump chamber 45 of the oil pump 45, 46. Finally piece 59 may—on its own or in conjunction with bearing piece 13—also form the only bearing on the pump side of motor shaft 36.

Figure 4:
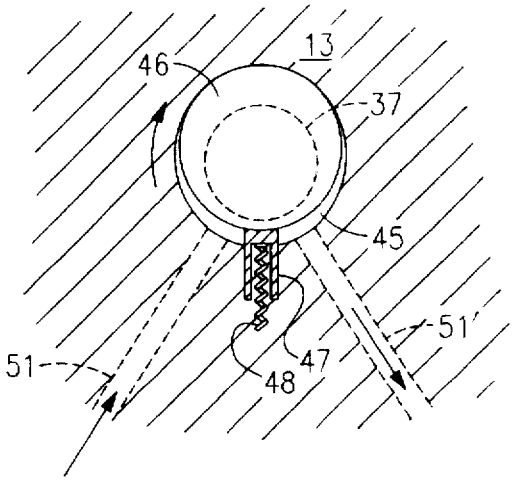
FIG. 4 shows an oil pump where the rotor is part of the coupling piece.
Figure 6:
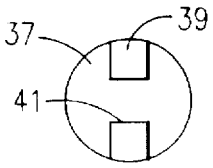
FIG. 6 shows a left end view of the oil pump with a rotor illustrated in FIG. 5.

Shown in drawing FIG. 4 is a section through the end piece 13 at the level of the oil pump 45, 46. The rotor 46 which is arranged eccentrically with respect to the axis of coupling piece 37, rotates in pump chamber 45. The rotor 46 and the coupling piece 37 are made of one piece. The stopper 47 which rests against rotor 46 defines the intake space which is linked to bore 51. Line 51' forms the discharge of the oil pump.

Figure 5:
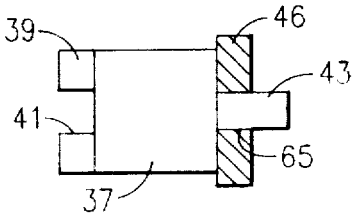
FIG. 5 shows an oil pump with a rotor which is linked by way of a positive fit to the coupling piece.
Figure 7:
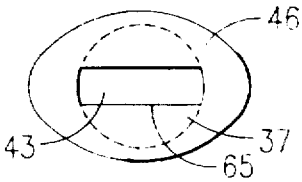
FIG. 7 shows a right end view of the oil pump with a rotor illustrated in FIG. 5.

Shown in drawing FIG. 5 are three different views of a coupling piece 37 where rotor 46 is a separate component. It is linked to the coupling piece 37 by way of a positive fit, by being equipped with a oblong passage 65 matched to projection 43. Projection 43 is designed to be longer by the axial extent of rotor 46 and forms the catch for the rotor. Thus the chain of tolerances can be interrupted, i.e. tolerances which affect running of the rotor 46 can be compensated in an improved manner. Moreover, the eccentric 46 does not obstruct the effect of spring 50 (drawing FIG. 1) on the rotor 3 and thus the desired reduction of the slot between end piece 12 and rotor 3.

The rotor 46 according to drawing FIG. 5 also differs from the rotor 46 according to drawing FIG. 4 in that it is oval. Per turn of shaft 36, an oil pump with such a rotor has two pumping phases. Also polygon profiles with three or more corners may be employed.

The design examples which are presented, are based on a minimum number of individual parts. This is achieved by components taking over several functions. Thus the pump according to the present invention is easier to manufacture and thus more cost-effective.

We claim:

1. Oil-sealed vacuum pump (1) with a pump chamber (8, 9), with a rotor 3 rotatively mounted therein, with a bearing piece (13) delimiting the pump chamber on a drive side and with a passage (35) in the bearing piece (13) which contains a coupling piece (37) used to interlock the rotor (3) with a shaft (36) of a drive motor (4) and a sealing ring (55) to seal off the coupling piece from the passage (35) in the bearing piece (13), wherein the creation of connections with a positive fit between rotor (3) and coupling piece (37) as well as between coupling piece (37) and shaft (36) is effected via projections and corresponding recesses; and that the coupling piece (37) is a support for a rotor (46) for an oil pump (45, 46), a pump chamber (45) of which is formed in a working piece (13).

2. Pump according to claim 1, wherein the coupling piece (37) and the rotor (46) of the oil pump (45, 46) are made of a single piece.

3. Pump according to claim 1, wherein the coupling piece (37) and the rotor (46) of the oil pump (45, 46) are separate components which, during operation, are linked together by means of a positive fit.

4. Pump according to claim 3, wherein a connection with positive fit of coupling piece (37) with rotor (3) or the shaft (36) forms at the same time a connection with a positive fit between coupling piece (37) and rotor (46).

5. Pump according to claim 4, wherein the oil pump (45, 46) is arranged on the side of the drive, the coupling piece (37) is equipped with a projection (43) and so that projection (43) is linked by way of a positive fit to both the rotor (46) of the oil pump (45, 46) and the shaft (36) of the drive motor (4).

6. Pump according to claim 1, wherein a face side of the rotor (3) is equipped with a recess (38) for accepting a projection (39) of the coupling piece (37).

7. Pump according to claim 6, wherein the recess (38) has an oblong shape, extends approximately perpendicular to the vane slot (26) in the rotor (3) and crosses the slat and that the projection (39), whose size corresponds to the recess in the coupling piece (37), has a recess (41) which embraces a vane (28).

8. Pump according to claim 1, wherein a face side of the rotor (3) is equipped with projections (44) for the creation of a connection by way of a positive fit with the coupling piece (37).

9. Pump according to claim 1, wherein the inlet (51) of the oil pump (45, 46) is linked via a channel (51) to the oil sump (20) the vacuum pump.

10. Pump according to claim 1, wherein a piece (59) is provided which limits the pump chamber (45) of the oil pump (45, 46) on the side of the drive, said piece having a passage (62) for the shaft (36) being equipped with a recess (64) for a second shaft seal (63).

11. Pump according to claim 10, wherein the end plate (13) is equipped with a recess (58) for the piece (59) and so that piece (59) is maintained in its operational position by a housing (61) of the drive motor (4).

12. Pump according to claim 1, wherein a spring (50) is arranged between rotor (3) and shaft (36) which exerts axially directed forces on to the rotor (3) and the shaft (36).

13. Pump according to claim 12, wherein the spring (50) is situated between coupling piece (37)[3] and shaft (36).

[3] Translator's note: The German sentence here assigns 3 to the coupling piece. 37 should be assigned instead, this being in line with the remaining text and the numbers in the drawing figures. The latter has been assumed for the translation.

14. Pump according to claim 5, wherein a spring (50) is supported by the projection (43) of the coupling piece (37) and in a pocket hole 49 in a face side in shaft (36).

* * * * *